United States Patent [19]

Yoshioka

[11] 4,241,855

[45] Dec. 30, 1980

[54] FLOW CONTROLLING POURING SPOUT

[75] Inventor: Yu Yoshioka, Los Angeles, Calif.

[73] Assignee: Kikkoman Foods, Inc., Elkhorn, Wis.

[21] Appl. No.: 30,121

[22] Filed: Apr. 16, 1979

[51] Int. Cl.[3] ..... B67D 3/00; B65D 47/00

[52] U.S. Cl. ..... 222/479; 222/481.5; 222/482; 222/541; 222/536; 222/547; 222/553; 222/569; 222/570; 222/545

[58] Field of Search ..... 222/545, 544, 547, 553, 222/569, 570, 566, 479, 481, 481.5, 482, 567, 568, 541, 543, 536, 537, 533, 498, 526; 220/85 SP

[56] References Cited

U.S. PATENT DOCUMENTS

| | | | |
|---|---|---|---|
| 1,895,759 | 1/1933 | Hagebusch | 222/566 |
| 2,536,160 | 1/1951 | Duggan | 222/566 X |
| 3,047,195 | 7/1962 | Richmond | 222/545 X |
| 3,104,786 | 9/1963 | Sanchis | 222/533 X |
| 3,371,827 | 3/1968 | Micallet | 222/536 X |
| 3,416,688 | 12/1968 | Fanning | 222/543 X |
| 3,606,096 | 12/1971 | Pierce . | |
| 3,630,419 | 7/1973 | Song . | |
| 3,744,675 | 9/1971 | Campbell . | |

*Primary Examiner*—Allen N. Knowles

*Attorney, Agent, or Firm*—Hill, Van Santen, Steadman, Chiara & Simpson

[57] ABSTRACT

A flow controlling pouring spout has a hollow body portion provided with structure to facilitate attachment to the lip about a pouring opening of a container. A spout portion extending normally generally horizontally communicates with the interior of the container through the hollow body portion and has a baffle separating a lower pouring passage and an upper displacement air passage which extends from adjacent to the discharge opening of the spout to the inner end of the spout and has a displacement air opening from the inner end of the air passage to the inner end of the pouring passage. A hinged closure plug is mounted on the discharge end of the pouring spout. Swivel structure connects the pouring spout with the base portion to permit turning the spout from pouring orientation to non-pouring orientation. Stabilizing and flow controlling slidably cooperating flanges are provided on the swivelly related base portion and spout.

10 Claims, 8 Drawing Figures

Fig. 1
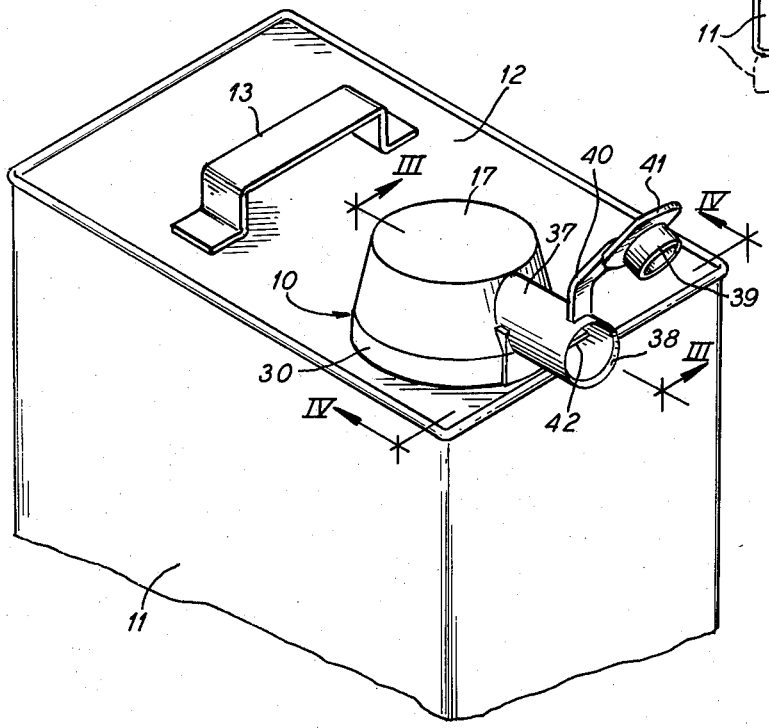
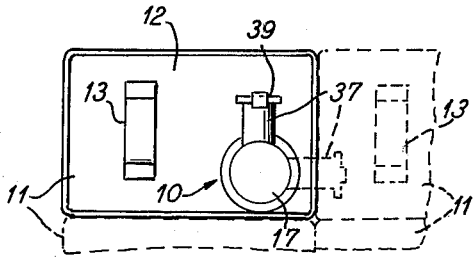
Fig. 2
Fig. 3
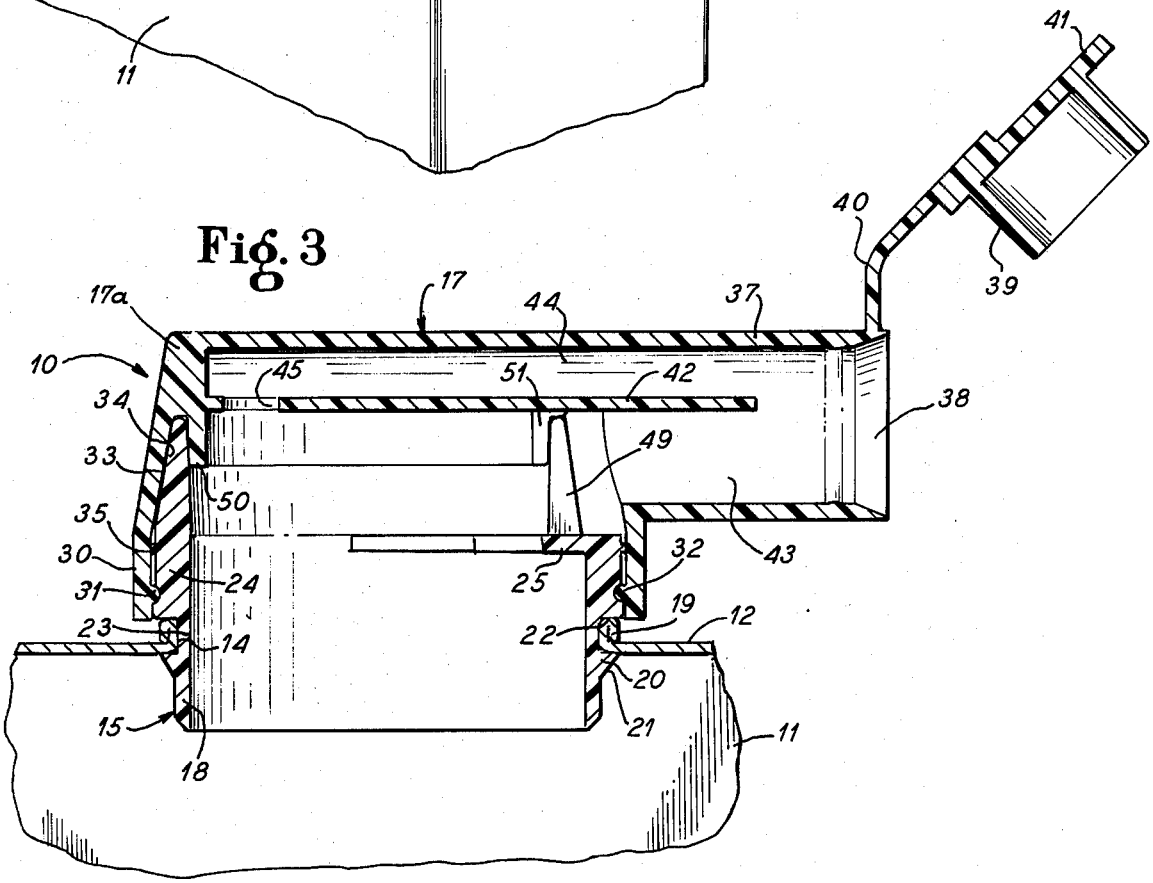

FLOW CONTROLLING POURING SPOUT

This invention relates to improvements in flow controlling pouring spouts, and is more particularly concerned with such a spout adapted to be mounted on a container having a pouring opening.

Sealing closures or pouring spouts are commonly formed from plastic material. An example of such a device is found in U.S. Pat. No. 3,744,674. That device comprises a body arranged to be attached to a bottle type container and provided with a rip out closure part. A hingedly secured cap is engageable on the body and is openable for pouring contents from the container by way of a channel shaped spout on the body. Various manufacturing problems are encountered with that device. Pouring control is inefficient, and the device is not suitable for use on flat top can type containers.

A pouring spout with an air passage is disclosed in U.S. Pat. No. 3,606,096 which involves a spring pressed expensive structure. In another arrangement as disclosed in U.S. Pat. No. 3,630,419 an air passage tube is provided requiring a separately formed part.

There has been need for substantial improvement in moldable plastic pouring spout structures and it is to that end that the present invention has been directed.

An important object of the present invention is to provide a new and improved flow controlling pouring spout which is constructed of easily molded snap-together parts.

Another object of the invention is to provide a new and improved flow controlling pouring spout having a novel displacement air entry arrangement to facilitate smooth pouring under efficiently controlled conditions.

A further object of the invention is to provide a new and improved pouring spout structure in which the spout is adapted to be swiveled relative to the base portion which is adapted to be secured to a container.

The invention is desirably embodied in a flow controlling pouring spout structure adapted to be applied in pourable contents flow controlling relation on a container having a discharge opening with a lip about the opening, the spout structure comprising a hollow base having means for retaining engagement with said lip, a tubular pouring spout carried by said base and having a passage communicating through the hollow interior of said base for pouring contents from the container, said passage having an inner closed end and an outer discharge opening end, a baffle in said passage extending from adjacent to said discharge opening end and defining with a top area of said spout an air displacement channel, said baffle separating said channel from pourable contents traveling through said passage, and said baffle having a limited area air displacement opening at the inner end of said passage to facilitate movement of displacement air into the container through the hollow base during pouring of the contents through the spout structure.

Other objects, features and advantages of the invention will be readily apparent from the following description of a certain representative embodiment thereof, taken in conjunction with the accompanying drawings although variations and modifications may be effected without departing from the spirit and scope of the novel cencepts embodied in the disclosure and in which:

FIG. 1 is a perspective view of a container having mounted thereon a pouring spout structure embodying the invention;

FIG. 2 is a reduced diameter top plan view of FIG. 1;

FIG. 3 is an enlarged fragmentary sectional detail view taken substantially along the line III—III of FIG. 1;

Figure 4:
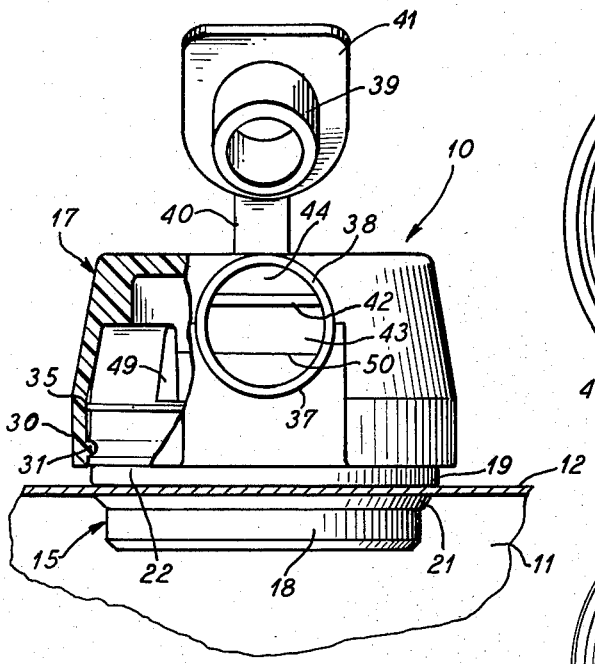
FIG. 4 is an enlarged sectional elevational detail view taken substantially along the line IV—IV of FIG. 1.

On reference to FIGS. 1 and 2, a spout structure 10 embodying the invention is depicted as mounted on a container 11 of the rectangular can type having a flat top 12 and a carrying handle 13. Containers of this type are often used for handling syrup, edible oil and like pourable contents. Pouring from the container 11 is desirably effected through an opening 14 (FIG. 3) adjacent to one corner of the top 12. Shipping and stacking of the container 11 with other containers requires that the containers abut one another face-to-face substantially as shown in FIG. 2. The subject container is depicted stacked with other like containers shown in phantom outline.

In preferred construction, the pouring spout structure 10 of the container 11 is molded from a suitable semi-rigid plastic material having good memory factor, that is, it is resiliently flexible and has the capability of returning to its molded shape when distorted. Advantageously, the spout structure 10 comprises a two part assembly including a hollow base 15 and a tubular pouring spout 17 carried by the base 15.

Means are provided for enabling assembly of the base 15 with the container 11 in the opening 14 by a snap-in assembly maneuver. For this purpose, the base 15 is provided with a skirt 18 dimensioned to fit snugly in the opening 14 in engagement with a reinforcing lip 19 which in the illustrated instance projects upwardly about the opening 14. For snap-in retaining engagement with the lip 19, the skirt 18 has means comprising an annular interlock shoulder rib 20 intermediate its length engageable under the container top 12 about the opening 14. On its underside, the shoulder rib 20 has a lead-in cam surface 21 to facilitate pressing the base 15 into position by camming the shoulder 21 downwardly on the lip 19 with sufficient pressure to effect resiliently deflectable distortion of the skirt 18 until the shoulder rib 20 snaps into place under the lip 19, and the upper edge of the lip 19 is engaged upon an annular downwardly facing shoulder 22 overlying the shoulder rib 20 and defining therewith an annular radially outwardly opening groove 23 in which the lip 19 is received. All dimensions within the groove 23 are such that in the mounted relation of the base 15 thereto a firm sealing grip is maintained with the engaged surfaces of the lip 19 and the top 12. Above the shoulder 22, the base has a wall 24 which has its inside diameter the same as the inside diameter of the skirt 18, but which is of greater mass than the skirt. As molded, the wall has at a desirable elevation, a horizontal closure wall 25 (FIGS. 3 and 6–8) so that when the base 15 is first assembled with the container 11, the opening 14 will be thoroughly sealed against inadvertent leakage or spilling of contents from the container, the base 15 serving as a closure cap for this purpose.

To facilitate quick opening of the top closure wall 25 when it is desired to pour, a portion 27 thereof is integrally attached along a molded inrupturable score line 28 and carries integrally on its top a pull tab 29 which is adapted to be manipulated to rip the separable portion 27 out along the score line 28.

In a preferred construction, the pouring spout 17 is constructed and arranged to be telescopically releasably assembled with the base 15 in a snap-together, snap-apart and swiveling manner. For this purpose, the spout 17 comprises a hollow downwardly opening generally inverted cup-shaped closed dome body 17*a* having a depending tubular skirt wall 30 engageable about the upstanding base wall 25. Adjacent to its lower end, the tubular wall 30 has means comprising a radially inwardly projecting annular interlock rib 31 which is engageable in snap-in retaining relation in an annular complementary receiving groove 32 in the radially outer surface of the wall 24. To facilitate assembling the parts, the base wall 24 has on a portion thereof extending upwardly beyond the closure wall 25 an annular upwardly and inwardly tapering lead-in cam surface 33 along which the rib 31 is adapted to be cammed toward its engaged relation with the wall 24, the resilient yieldability of the material of the parts permitting the press-on assembly. After the rib 31 has been received in the groove 32, the cam surface 33 is engaged slidably by a complementary annular sloping inner wall surface 34 of the spout body 17*a*, whereby a stable assembled relation is attained, providing substantial engaged areas of the surfaces 33 and 34 to resist leakage through the joint. Engagement of these surfaces is firm enough for the intended purpose, but nevertheless slidable so that the spout 17 can be swiveled about the base 15. Immediately above the rib 31 and the groove 32, the wall 24 and the skirt wall 30 are desirably in slight clearance relation to facilitate the snap-in, snap-off engagement of the rib 31, and a narrow annular sealing rib 35 is provided on one of the spaced surfaces, herein the outer annular surface of the wall 24 to engage the opposite wall 30. It will thus be apparent that a plurality of sealing engagements are effected between the relatively moveable parts.

Figure 8:
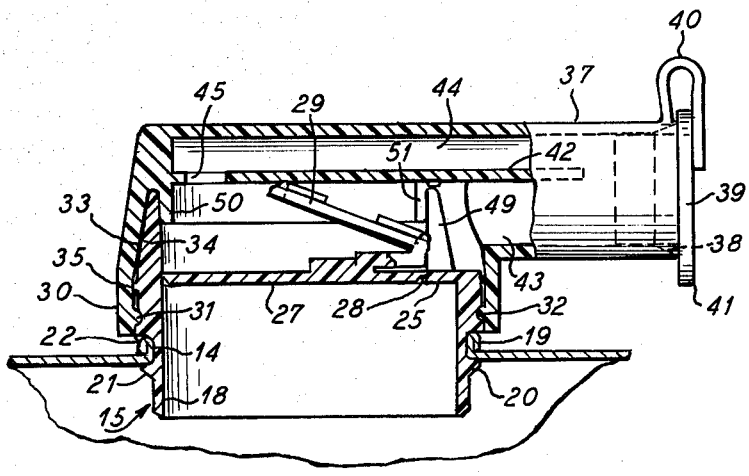
FIG. 8 is a view similar to FIG. 3 but showing the spout structure before it has been opened.

For controlled pouring of contents from within the container 11 through the hollow base 15 and the spout 17, after the closure portion 27 has been ripped out, an elongate laterally projecting tubular spout nozzle 37 is provided as a part of the spout body 17 and has a discharge opening or port 38 at its outer end and opens at its inner end into the upper portion of the hollow space within the spout body 17*a*. A removable closure plug 39 which is desirably attached integrally by means of a resiliently flexible hinge 40 to the top of the front end of the nozzle 37 is dimensioned to be frictionally forced into the front end of the nozzle 37 as shown in FIG. 8. The inner surface defining the opening 38 is chamfered, as seen in FIG. 3 to facilitate assembly of the plug 39. The plug 39 is of a sufficient length to fit in snug frictional relation within the cylindrical front end portion of the nozzle 37. To facilitate removal of the plug 39 when desired, it is provided with a digitally manipulatable radially extending finger grip flange 41. Through this arrangement, the plug 39 is adapted to be removed by gripping the flange 41 at the opposite side of the plug from the hinge 40. Because of the resilient nature of the material of the hinge 40, the plug may then be held substantially as shown in FIG. 3 in open clearance relation to the front discharge port 38 of the spout.

Figure 5:
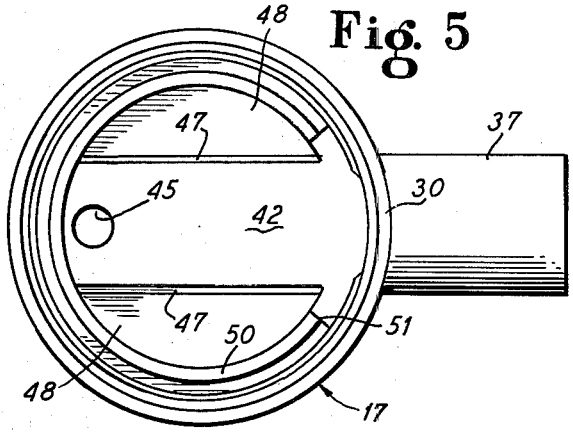
FIG. 5 is a bottom plan view of the spout portion of the pouring spout structure.

Within the spout 17 are means comprising a longitudinally extending partition or baffle 42 dividing the spout into a lower pouring passage 43 and an upper displacement air channel 44. In a preferred construction, the baffle 42 comprises a thin horizontal wall which is closer to the top of the nozzle 37 than to the bottom of the nozzle so that the pouring passage 43 is substantially greater in cross-sectional area than the air channel 44. At its front end, the baffle 42 is spaced inwardly from the opening 38 at least sufficiently to provide clearance for reception of the plug 39 within the nozzle 37. At its inner or rear end, the baffle 42 extends into integral connection with the wall of the body 17*a* opposite the nozzle 37. A small opening 45 through the inner end portion of the baffle 42 permits displacement air reception at the back of the pouring passage 43, to be sucked into the container through the open hollow base 15 during a pouring action. Since the diameter of the nozzle 37 is smaller than the diameter of the body of the spout body 17*a*, the baffle 42 is carried inwardly from the inner end of the nozzle 37 between side closure walls 47 (FIG. 5), thereby providing between the longitudinally extending walls 47 and the arcuate sides of the upright wall of the spout body 17*a* cavities 48 which increase the capacity of the inner portion of the spout without interfering with air displacement to the back of the assembly during pouring.

Figure 6:
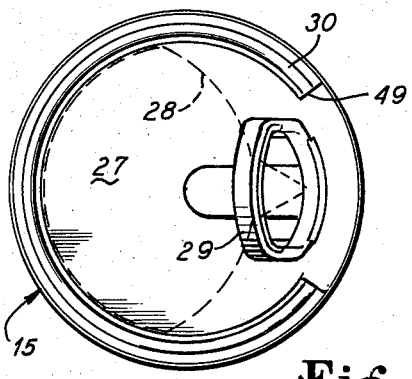
FIG. 6 is a top plan view of the base portion of the pouring spout structure.
Figure 7:
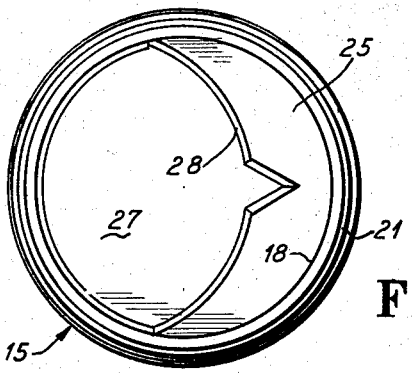
FIG. 7 is a bottom plan view of the base structure of the pouring spout structure.

For controlled pouring flow of contents from within the container 11 through the spout structure 10, the upstanding portion of the base wall 24 has a vertical gap 49 therein which is aligned with the solid remaining portion of the base wall 25 after the closure area 27 has been removed. As best seen in FIG. 6, the width of the gap 49 is substantially less than the diameter of the top portion of the wall 24, and as observed in FIG. 4, the gap 49 is sufficiently greater than the diameter of the nozzle 37 to provide a substantial funnel toward the inner end of the pouring passage 43 for material flowing from the opening in the base wall 25 into the pouring passage 43 and under the baffle 42. Additional pouring control is afforded by means of a downwardly projecting annular flange 50 extending from the roof of the spout member 17 into slidable engagement with the upper inner wall surface of the upstanding portion of the base wall 24. A gap 51 in the control flange 50 matches the gap 49 in the pouring orientation of the spout 17. In addition, the flange 50 cooperates with the upstanding portion of the wall 24 and with the wall 30 to provide strength and stability to the assembly, permmitting the base 15 and the spout 17 to be made from minimum material.

In a desirable arrangement, the base 15 is mounted on the container top 17 with the pouring clearance gap 49 directed toward one vertical side of the container 11, such as toward the adjacent narrow side and in a direction away from the handle 13. Thus, when the discharge spout nozzle 37 is aligned with the pouring gap 49, and the gap 51 is aligned with the gap 49, pouring of contents from within the container 11 is facilitated, assuming that the closure portion 27 has been removed. If such closure portion has not been removed, then it is a simple matter to snap the spout 17 free from the base 15 to gain access to the pull tab 29. After the portion 27 has been removed, the spout nozzle 17 can be quickly snapped back into assembly with the base 15. As material is poured through the pouring passage 43, displacement air is adapted to enter through the air passage 44 and the port 45, to the back of the spout structure 10 and easily into the container 11 over the content material being poured. Thereby, smooth unagitated, controlled pouring is adapted to be effected by means of the spout structure 10.

By virtue of swivel mounting of the spout 17 on the base 15, the spout 17 is adapted to be turned into a position where it is clear of the sides of the container 11, as shown in full outline in FIG. 2. This greatly facilitates handling of containers equipped with the spout 10 in stacked relation as will be evident on comparison of the full line and dash outline positions of the spout tube 37 in FIG. 2. For effecting swiveling of the body 17*a* relative to the base 15, the spout 37 provides a convenient manipulative handle. In its handle function, the projecting spout 37 also facilitates applying leverage for snapping the cap-like spout member 17 from the base member 15 for access to the separable closure portion 27.

Further, it may be noted that when the spout 17 is turned into the full line clearance position in FIG. 2, or any position about 90° or more from the forwardly extended pouring position as depicted in dash outline in FIG. 2, the pouring gaps 49 and 51 are out of register and the depending flange 50 cooperates with the upper annular flange portion of the base wall 24 to substantially close the interior of the spout structure 10 against unintentional escape of contents. At the same time, by closing the opening 38 by means of the plug 39, entry of foreign matter and air into the container through the spout structure 10 is precluded. Therefore, the spout structure 10 may serve not only as an efficient controlled pouring device, but also as an efficient closure for the container 11 even after the rupturable closure area 27 has been removed.

It will be understood that variations and modifications may be effected without departing from the spirit and scope of the novel concepts of this invention.

I claim as my invention:

1. A flow-controlling pouring spout assembly adapted to be applied in flow-controlling relation to a discharge opening in a pourable contents container, said assembly comprising:

a base member having means for retaining engagement with the container in flow-controlling relation to said opening;

said base member having a flow passage therethrough initially closed by rupturable means extending across the flow passage;

a pouring spout member having a discharge port opening generally radially therefrom;

and means separably connecting said pouring spout member in snap-on, snap-off and relatively swiveling relation on said base member for receiving and directing container contents flow from said base member passage through said port and permitting said spout member to be selectively swiveled relative to said base member for orienting said port in different radial directions relative to said base member;

said pouring spout member being adapted to be snapped from said base member for access to and removal of said rupturable means for opening said passage, whereafter the pouring spout member is adapted to be snapped back into swiveling connection with said base member for cooperating with the base member in directing flow of container contents from the opened base member passage.

2. An assembly according to claim 1, wherein said connecting means comprise telescoped portions of said members, at least one of said telescoped portions being resiliently yieldable relative to the other of said portions, one of said telescoped portions having releasable interlock depression means, and the other of said portions having releasable interlock projection means releasably engageable in said interlock depression means.

3. An assembly according to claim 2, wherein said telescoped portion of said base member is received within the telescoped portion of said spout member, said telescoped portion of the spout member being a resiliently flexible flange, said depression means comprising an annular groove in the outer perimeter of said base portion and said projection means comprising an annular rib on said spout portion, said spout member having a generally radially extending integral nozzle, and said nozzle serving as a handle for applying leverage for separating said spout member from said base member.

4. An assembly according to claim 3, wherein said telescoped portions have confronting surfaces which are spaced apart inwardly from said interlocking rib and groove whereby to facilitate resilient flexing of said resiliently flexible flange when applying said spout member to said base member or releasing said spout member from said base member, and a sealing bead on said base member portion spaced inwardly from said groove and sealingly engaging said spout member flange.

5. A flow-controlling pouring spout assembly adapted to be applied in position with respect to a pouring opening in a container to control flow of pourable contents through said opening from within the container, said assembly comprising:

a hollow base member having means for retaining engagement with the container at said opening;

a pouring spout member having a discharge port and comprising a substantially cap-like structure engaging in telescoped relation about said base member, said base member and spout member having swivel surfaces including means for retaining the members in assembly;

said members providing a passage from within the container through said opening to said discharge port;

and said members having internal telescopically cooperating flow controlling annular flange means which are annularly continuous except for registerable gaps adapted to be aligned with said discharge port in one relative swiveled orientation of said spout member and said base member, and which gaps are out of registration in another relatively swiveled orientation of said spout member and said base member whereby to block flow through said passage to said port.

6. An assembly according to claim 5, wherein said spout member has a replacement air channel leading from adjacent to said port to the inside of said spout member and communicating with said passage through a small opening located remote from said gap in the pouring spout member flange.

7. An assembly according to claim 5, wherein said base member has a rupturable closure across said passage, means for separably connecting said members in pressed together, snap apart relation, and permitting relative swiveling of the members, and said port being at the distal end of an elongate nozzle projecting generally radially integrally on said spout member in communication with said passage and serving as a handle for applying leverage for snapping said spout member free from said base member for access to said rupturable closure to enable removal of said closure whereafter the spout member is adapted to be replaced by pressing it into connected relation to said base member.

8. A flow controlling pouring spout assembly adapted to be applied to a container in pourable contents flow controlling relation at a discharge opening in the container, the assembly comprising:

a hollow base member having means for attachment to the container at said opening;

a hollow pouring spout member having a discharge port;

said members having respective telescopically related circular surfaces;

one of said surfaces having an annular groove;

the other of said surfaces having an annular rib fitting in swiveling relation in said groove; and one of said surfaces having an annular sealing bead spaced from said groove and rib and sealingly engaging the other of said surfaces for sealing the swivel joint between said surfaces against leaking.

9. An assembly according to claim 8, wherein said members have internal flow controlling telescoped annular portions which are annularly continuous except for respective registrable gaps, said gaps being aligned with said discharge port in one relative swiveled orientation of said members and said gaps being out of registration and said portions cooperating for blocking access to said port in another relative swiveled orientation of said members.

10. An assembly according to claim 9, wherein said spout member has an air relief channel extending from adjacent to said port and past said annular portions and having a small opening communicating with the interior of said passage member remote from the gap in said annular portion of said spout member.

* * * * *